US005871263A

United States Patent [19]

Johnston et al.

[11] Patent Number: 5,871,263

[45] Date of Patent: Feb. 16, 1999

[54] MERCHANDISE DISPLAY CASE WITH AN IMPROVED GANG LOCK UNIT

[75] Inventors: Michael Johnston, Occidental; Sergei Anderson, Cotati, both of Calif.

[73] Assignee: Trinity Engineering, Rohnert Park, Calif.

[21] Appl. No.: 898,227

[22] Filed: Jul. 22, 1997

[51] Int. Cl.[6] ..... E05B 65/46

[52] U.S. Cl. ..... 312/217; 312/215; 312/107.5

[58] Field of Search ..... 312/217, 216, 312/219, 215, 107.5, 109, 139.2, 333, 220, 218

[56] References Cited

U.S. PATENT DOCUMENTS

| | | | |
|---|---|---|---|
| 681,155 | 8/1901 | Tobey . | |
| 683,852 | 10/1901 | Ferry et al. . | |
| 1,352,902 | 9/1920 | Kramer | 312/215 |
| 1,462,780 | 7/1923 | Yanchik . | |
| 1,486,094 | 3/1924 | Lehman | 312/107.5 |
| 1,631,844 | 6/1927 | Walsh | 312/107.5 |
| 2,202,539 | 5/1940 | Siegel . | |
| 2,543,643 | 2/1951 | Ryan et al. . | |
| 2,853,352 | 9/1958 | Gittins . | |
| 3,175,872 | 3/1965 | Sullivan . | |
| 3,318,646 | 5/1967 | Ibel . | |
| 3,325,234 | 6/1967 | Lewin | 312/333 X |
| 3,497,280 | 2/1970 | Olree et al. . | |
| 3,511,549 | 5/1970 | Macaluso . | |
| 3,589,783 | 6/1971 | Studinski | 312/217 X |
| 3,998,508 | 12/1976 | Scheerhorn . | |
| 4,036,541 | 7/1977 | Kantor | 312/217 X |
| 4,057,306 | 11/1977 | Besch, Jr. . | |
| 4,246,769 | 1/1981 | McLaughlin . | |
| 4,303,288 | 12/1981 | Aschinger | 312/215 |
| 5,802,891 | 9/1998 | Kahawa et al. | 312/333 X |

OTHER PUBLICATIONS

Kenstan Lock, "Drawer Gang Locks, KIC 28 Series" brochure p. 13, Jul. 1, 1993.

Kenstan Lock, "Drawer Dead Bolt Locks, KIC 24 Series" brochure p. 6, Jul. 1, 1993.

Miscellaneous drawing of "Target" Gang Lock Detail (no date given).

*Primary Examiner*—Peter R. Brown
*Assistant Examiner*—James O. Hansen
*Attorney, Agent, or Firm*—Donald L. Beeson

[57] ABSTRACT

A merchandise display case has vertically arranged compartments in a cabinet for providing a storage area and a display area, and a gang lock unit which simultaneously locks a bank of drawers in the storage area and cabinet doors covering the display area. The gang lock unit includes a rigid, vertical gang bar which carries the locking means for both the cabinet doors and the bank of drawers and which is moved between its locking position and unlocking position by means of a single accessible locking mechanism. The gang bar preferably has a rectangular or square cross-sectional shape that prevents flexure in any direction and that contributes to the smooth locking action of the gang lock unit.

29 Claims, 9 Drawing Sheets

MERCHANDISE DISPLAY CASE WITH AN IMPROVED GANG LOCK UNIT

BACKGROUND OF THE INVENTION

The present invention generally relates to the display and storage of retail merchandise, and more particularly to merchandise display cases capable of being secured against unauthorized access.

Most retail establishments use merchandise display cases to provide sales countertops and secure areas for displaying and storing merchandise. In a typical arrangement, a display case has vertically arranged compartments which include an upper display area accessible through sliding cabinet doors at the "back" of the display case, i.e., the side accessible to store personnel, and a lower storage area, also accessible from the back of the case, which has one or more banks of storage drawers. To properly secure the merchandise display case against unauthorized access, all drawers and doors of the case must be locked. This is conventionally achieved by means of separate locking mechanisms—one for the banks of drawers and one for the cabinet doors—which must be separately keyed by store personnel who are apt to forget one or the other. Where numerous display cases are used the problem of properly locking up increases due to the increase in the number of locks that must be keyed.

Conventional merchandise display case designs have other drawbacks associated with the frequent use of gang locks for locking the bank or banks of drawers provided in the display case. One commonly used gang lock mechanism, known as the "Target" gang lock, is used to lock all but the topmost drawer within a bank of drawers. In the Target lock, a gang lock mechanism is located at the rear of the drawers and is actuated by a lever accessible through the topmost drawer after the topmost drawer is opened. Such a system has a number of disadvantages. First, it is awkward to use because of the requirement to reach within the top drawer of the display case to actuate the locking mechanism. Often, store clerks will forget to do this, resulting in a failure to secure the entire case. Secondly, the locking mechanism, which involves the rotation of a vertical rod in an arc about a vertical support post to engage locking brackets at the rear of the drawers, occasionally jams in the brackets rendering one or more drawers inoperable. The Target lock has further disadvantages in that it takes up valuable space within the cabinet of the merchandise display case and is difficult to maintain and install.

Another gang lock mechanism heretofore utilized in merchandise display cases is the KIC28 Series gang lock manufactured by Kenstan Lock, of Huntington Station, N.Y. The Kenstan lock simultaneously locks a vertical bank of drawers from a keyed lock accessible from the outside of the display cabinet. Also, the Kenstan lock provides a vertical gang bar which is operative in the front part of the cabinet and thus avoids the need to provide locking hardware at the rear of the cabinet drawers. Thus, the Kenstan lock overcomes some of the above-mentioned disadvantages of the Target system. However, the gang bar assembly of the Kenstan lock is made up of relatively thin gauged metal parts which tend to twist and hang up in the cabinet and which can break with repeated use. Also, the Kenstan lock can only be used to secure the drawers of a display case; a separate locking mechanism is still required to secure the display case's upper cabinet doors.

The present invention overcomes the drawbacks of conventional locking systems for merchandise display cases by providing a gang lock unit that permits a bank or banks of drawers within the display case as well as the display case's cabinet doors to be simultaneously locked by means of a single, accessible locking mechanism. The present invention also provides a gang lock unit for a merchandise display case that can be fabricated at relatively low cost, that is easy to install, and that takes up relatively little space in the cabinet of the display case. Additionally, the gang lock unit of the invention provides for a smooth locking action and reduces the tendency of gang locks to jam or fail with repeated use.

SUMMARY OF THE INVENTION

Briefly, the present invention involves a securable merchandise display case and gang lock unit therefor. The display case is comprised of a cabinet having a back face and vertically arranged first and second compartments behind the cabinet's back face. At least one storage drawer is disposed within the first of the cabinet's compartments and is slidable between a closed and an open position in a direction perpendicular to the back face of the cabinet, while at least one cabinet door is provided in the back face of the cabinet to control access to the display area provided by the cabinet's second compartment. A gang lock unit in accordance with the invention simultaneously locks both the drawers and the cabinet doors of the display case.

The gang lock unit of the invention includes a vertically movable gang bar which extends through the first compartment of the cabinet laterally adjacent the cabinet drawers and which has a projecting end that extends to an elevation within the cabinet near the elevation of a catch means on the cabinet door. In the preferred embodiment of the invention, the gang bar is a straight, rigid bar having a cross-sectional shape that prevents flexure in any direction, with a particularly suitable shape being a square or other rectangular cross-sectional shape which is inherently rigid and which allows the bar to be easily contained within a guide channel provided in the first compartment of the cabinet. It is particularly contemplated that the gang bar can be fabricated from a rigid and durable tubing material such as steel tubing.

The drawers and cabinet doors of the display case are simultaneously locked by first and second locking means which are carried on, and which move vertically with, the gang bar. The first locking means, suitably in the form of locking posts extending laterally of the gang bar, lockingly engage catch means on the drawers when the drawers are in their closed position and when the gang bar is vertically moved from an unlocking position to a locking position. When the cabinet door is closed, this same movement of the gang bar will cause the second locking means, which is provided on the gang bar's projecting end, to vertically move into lockingly engagement with the catch means on the cabinet door. The gang bar's second locking means is suitably in the form of an upwardly extending engaging element for grabbing a catch means on the lateral edge portion of the cabinet doors closest the cabinet's first compartment. The engaging element can be attached to the projecting end of the gang bar by means of a horizontal offset support bracket as required to bring the engaging element into proper alignment with the cabinet doors. Such an offset support bracket would not be required with a cabinet design which placed the cabinet doors directly above the gang bar.

The invention's gang lock unit further includes a locking mechanism which is preferably accessible from the back face of the display case and which is operatively connected to the unit's gang bar to vertically move the gang bar between its locked and unlocked position. The locking mechanism can suitably be provided in the form of a conventional keyed cylinder lock mounted in the back face of the cabinet below a horizontal lifting bracket extending from the gang bar. The bar's lifting bracket is attached to the locking bolt of the cylinder lock such that the throw of the locking bolt acts to vertically reposition the gang bar. In one illustrated embodiment the lifting bracket for the cylinder lock also serves as the offset support bracket used to position the gang bar's engaging element beneath the cabinet doors.

Therefore, it can be seen that a primary object of the present invention is to provide a securable merchandise display case having a gang lock unit which can simultaneously lock all the drawers and doors of the display case with a single locking mechanism. Another object of the invention is to provide a merchandise display case having a gang lock unit which has few parts and which operates reliably with a smooth locking action. A further object of the invention is to provide a gang lock mechanism for a merchandise display case which occupies a relatively small volume within the display case which can be easily fabricated, and which is easy to install. Still further objects of the invention will be apparent from the following specification and claims.

DETAILED DESCRIPTION OF THE ILLUSTRATED EMBODIMENT

Figure 1:
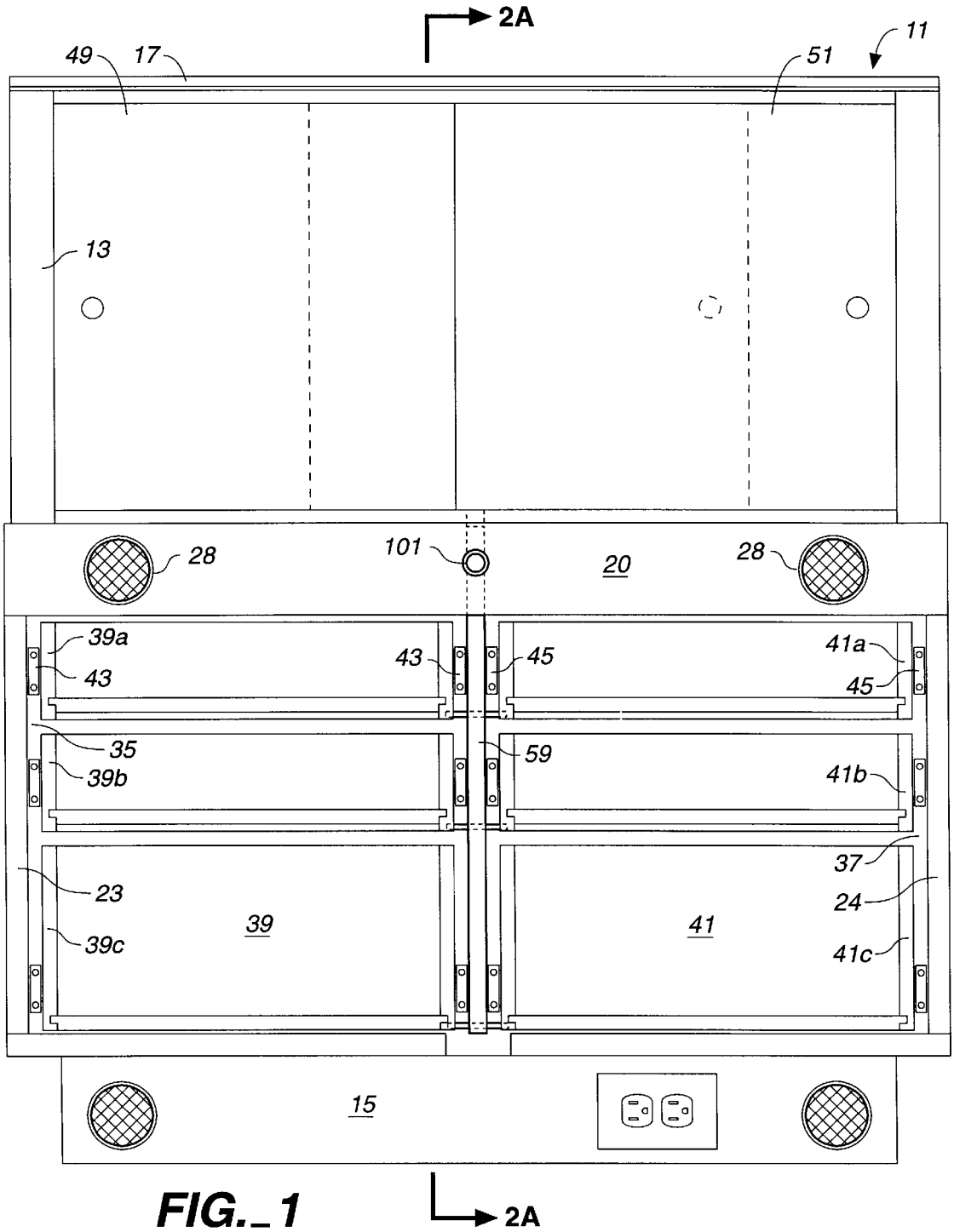
FIG. 1 is a rear elevational view of a merchandise display case having a gang lock unit in accordance with the invention, which is partially cut away as shown by section lines 1—1 of FIG. 2A to reveal the gang bar of the gang lock unit of the invention.
Figure 2A:
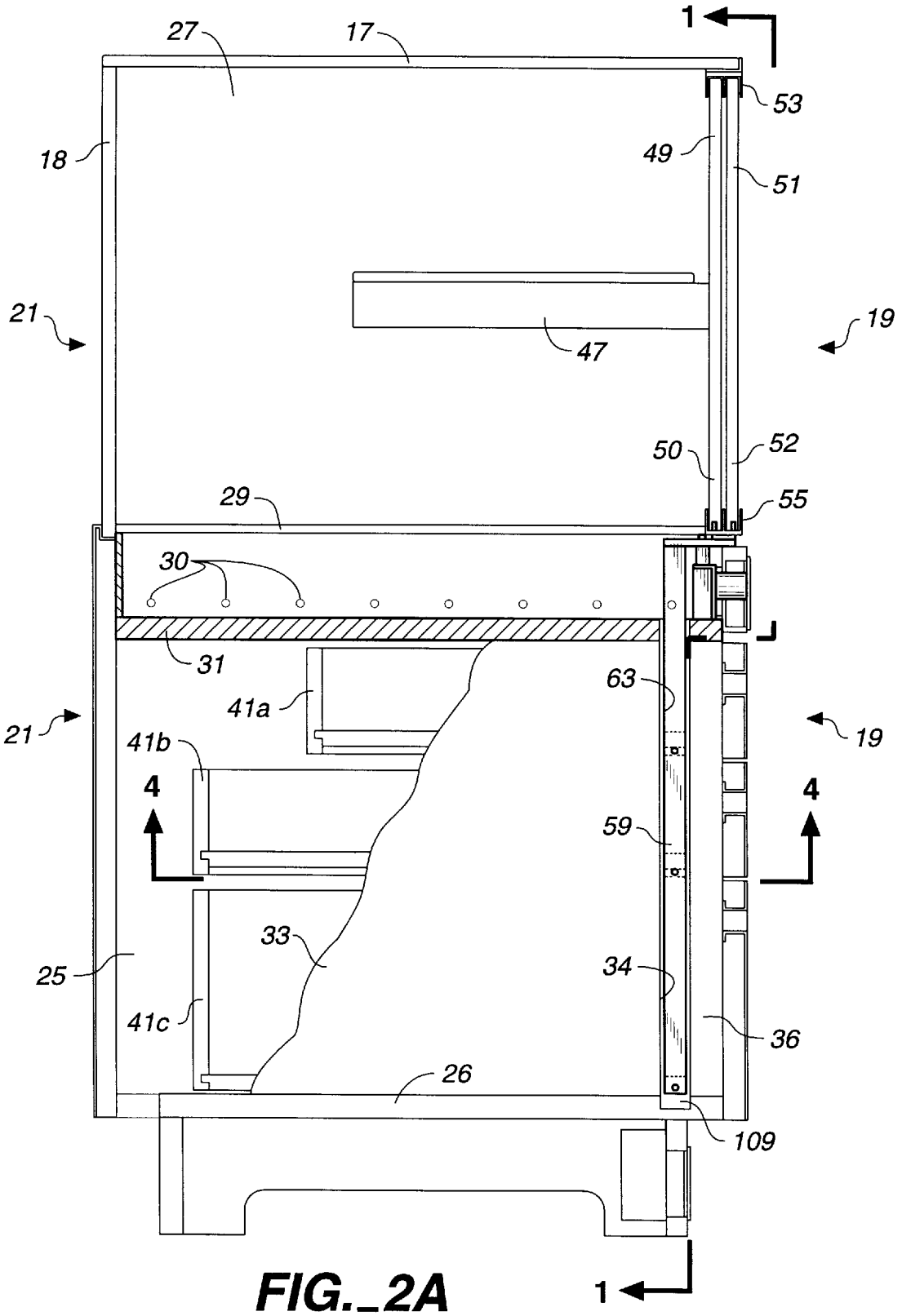
FIG. 2A is a cross-sectional view of the merchandise display case of FIG. 1 taken along section lines 2A—2A, showing the gang bar of the gang lock unit in its locking position, and showing a fragmentary view of the vertical partition wall separating the display cases's two banks of drawers.
Figure 2B:
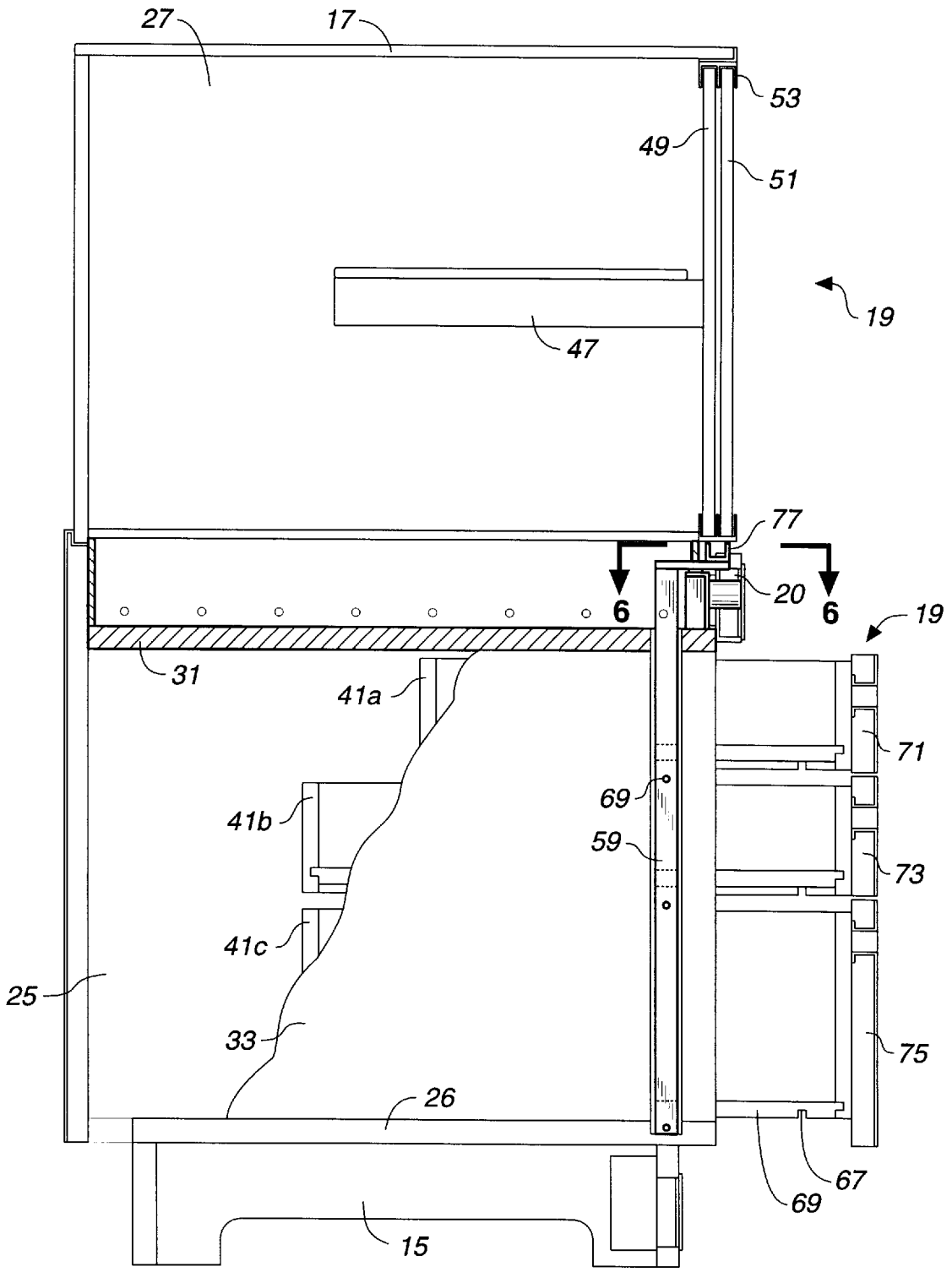
FIG. 2B is the same view of the merchandise display case shown in FIG. 2A, except with the gang bar of the gang lock unit lowered to its unlocking position and the drawers of the display pulled to an open position.

Referring now to the drawings, FIGS. 1, 2A and 2B illustrate a merchandise display case 11 having an upright cabinet 13 over which retail customers can be served and in which retail merchandise can be displayed and stored. The cabinet 13, which stands on base 15, includes a glass countertop 17, a back face 19, a front face 21, and side walls 23, 24, and is divided into vertically arranged first and second compartments 25, 27 by internal horizontal panels 29, 31. The first compartment 25, which provides a lower storage area in the cabinet, is in turn subdivided by a vertical center partition wall 33 to form side-by-side smaller compartments 35, 37 which house two banks of drawers 39, 41. As shown in FIG. 1, the drawer banks are mounted between the center partition wall 33 and the side walls 23, 24 of the cabinet by means of commercially available drawer slides 43, 45, and are accessible from the side of the display case on which the retail clerk stands, namely, on the side of back face 19 of the cabinet. Each drawer 39*a*, 39*b*, 39*c* and 41*a*, 41*b*, 41*c* within each drawer bank is slidable between a closed position and an open position in a direction perpendicular to the cabinet's back face as shown in FIG. 2B.

The second of the cabinet's vertically arranged compartments is the uppermost compartment 27. This compartment is situated directly beneath the cabinet's top counter 17 and provides a display area for the retail merchandise. The display area, which can be viewed by a customer standing in front of the front face 21 of the cabinet through the glass countertop and through vertical glass display wall 18, is provided with a merchandise display shelf 47 accessible through a pair of overlapping sliding doors 49, 51 held in upper and lower slide tracks 53, 55. (Each of the cabinet doors are movable between a closed position to an open position as shown by the phantom line representation of door 51 in FIG. 1.) The displayed merchandise is illuminated by a series of fluorescent lamps 30 held in the narrow space formed between the horizontal divider panels 29, 31. The heat from these lamps is vented by means of vent openings 28 in the back face of the cabinet.

It can be seen that the display and storage areas of the cabinet are both accessible from one side of the display case only with no access being provided from the other. As hereinafter described, access to the display case is controlled by an unique gang lock unit wherein the banks of drawers 39, 41 and the sliding doors 49, 51 can be simultaneously secured by keying a single locking mechanism accessible.

Referring to FIGS. 1–7, the gang lock unit of the invention includes a straight, rigid, and vertical gang bar 59 which extends through the cabinet's lower storage area 25 behind the cabinet's back face 19, and which also extends between and laterally adjacent the two banks of drawers 39, 41. The cross-sectional size and shape of the gang bar are selected to prevent any bending or flexing of this part which can cause the gang lock unit to operate with difficulty or jam. A gang bar fabricated of ¾ inch square steel tubing having a wall thickness of 0.065 inches has been found to provide suitable weight and rigidity for efficient operation of the gang lock unit.

Gang bar 59 is seen to have a top projecting end 61 and lower portion 63, with the top projecting end extending to an elevation near the elevation of the lower slide track 53, 55 which retains the bottom edges 50, 52 of the sliding doors 49, 51. The gang bar is held by and moves within an internal gang bar support structure within the lower compartment of the cabinet which is comprised of vertical back edge 34 of partition wall 33, a vertical back edge strip 36 secured between the cabinet's bottom wall 26 and horizontal divider panel 31, and the interior drawer slides 43, 45. This internal support structure provides a guide channel 65 for the gang bar and permits the gang bar to be raised and lowered from its unlocking to locking position in a smooth action without becoming misaligned. It is also noted that the square shape of the gang bar will help the gang lock to operate smoothly because it reduces the potential for undesirable lateral movements of the bar within the guide channel structure.

To lock the banks of drawers 39, 41, first locking means are provided on the gang bar's lower portion 63 for lockingly engaging complementary catch means located on the drawers. In the illustrated embodiment, the catch means on each drawer are provided in the form of a notch 67 provided in the drawer's inner bottom edge 68 which is closest the gang bar. The first locking means on the gang bar are, in turn, provided in the form of short, laterally extending locking posts 69 which engage in the notches 67 of the drawers when the gang bar is moved to its locking position as hereinafter described. It is seen that notches 67 on the drawers are located close behind the drawer's front panels 71, 73, 75 so as to align with the gang bar when the drawers are in their closed position as shown in FIG. 2A.

A second locking means is provided on the gang bar 59 for similarly engaging a catch means on the cabinet door's bottom edges 50, 52. In describing the second locking means and the door's catch means, it is first observed that the gang bar, being positioned immediately behind the cabinet's back face 19, is offset somewhat behind the plane of the cabinet doors. Because this offset is small, the entire gang lock unit will occupy a relatively small and relatively accessible vertical region behind the back face of the cabinet. Nonetheless, the offset needs to be accounted for in the gang lock design. Specifically, the second locking means is provided in the form of an engaging element 77 held at the top end 61 of gang bar 59 by means of a horizontally extending offset support bracket 79. As best illustrated in FIGS. 2A and 2B, offset support bracket 79 holds the engaging element 77 in an offset relation to the gang bar so as to position the engaging element just below the cabinet door's lower slide track 55, and, specifically, below the slide tracks' two parallel slide channels 81, 83. In this position, the two upwardly projecting legs 85, 87 of the engaging element align with adjacent slots 89, 91 in the slide track channels, as well as with notches 93, 94 in the bottom lateral edges of the cabinet doors when the sliding doors are in their closed position. When closed, the sliding doors 49, 51 can be locked (i.e., prevented from sliding) by raising the gang bar such that the projecting legs of engaging element 77 extend through the slide track 55 and into the door notches 93, 94.

Figure 3A:
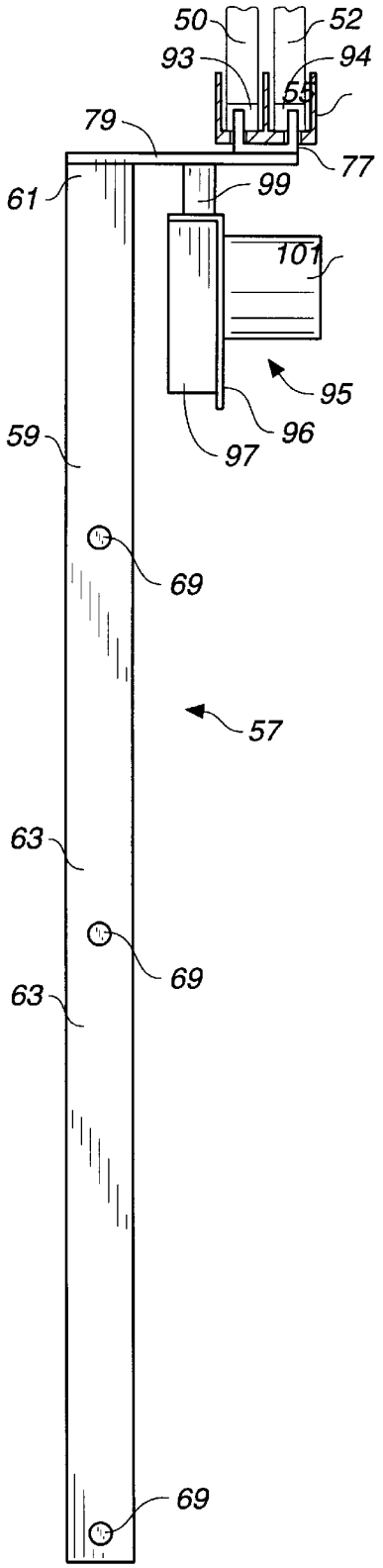
FIG. 3A is a side elevational view of the gang lock unit of the merchandise display case shown in FIG. 2A where the gang bar of the gang lock unit is in its locking position.
Figure 3B:
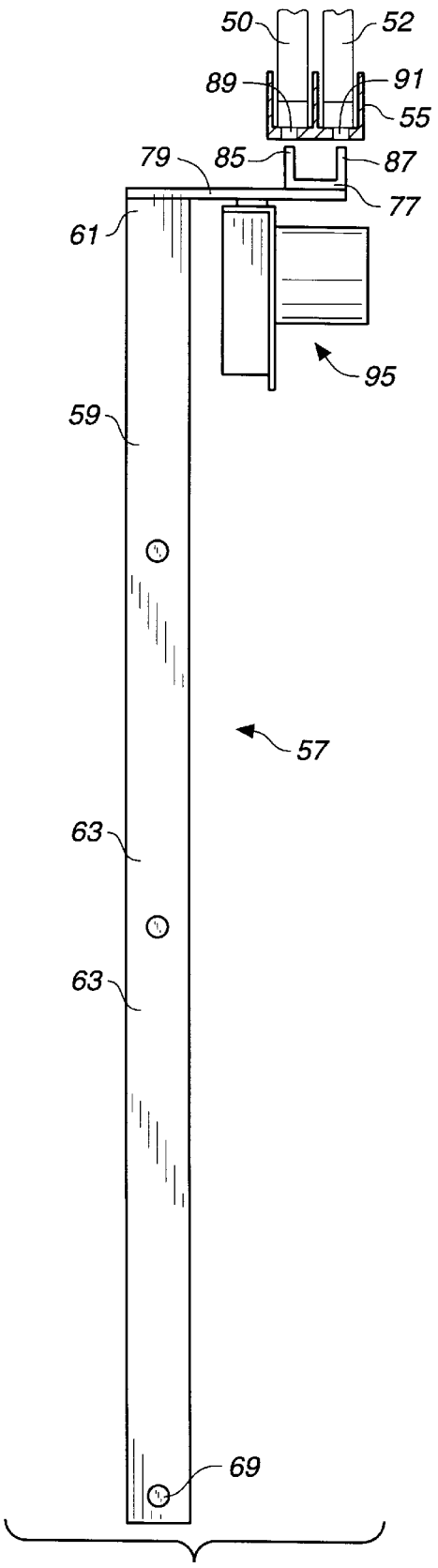
FIG. 3B is a side elevational view of the invention's gang lock unit with its gang bar lowered to its unlocking position as illustrated in FIG. 2B.
Figure 4:
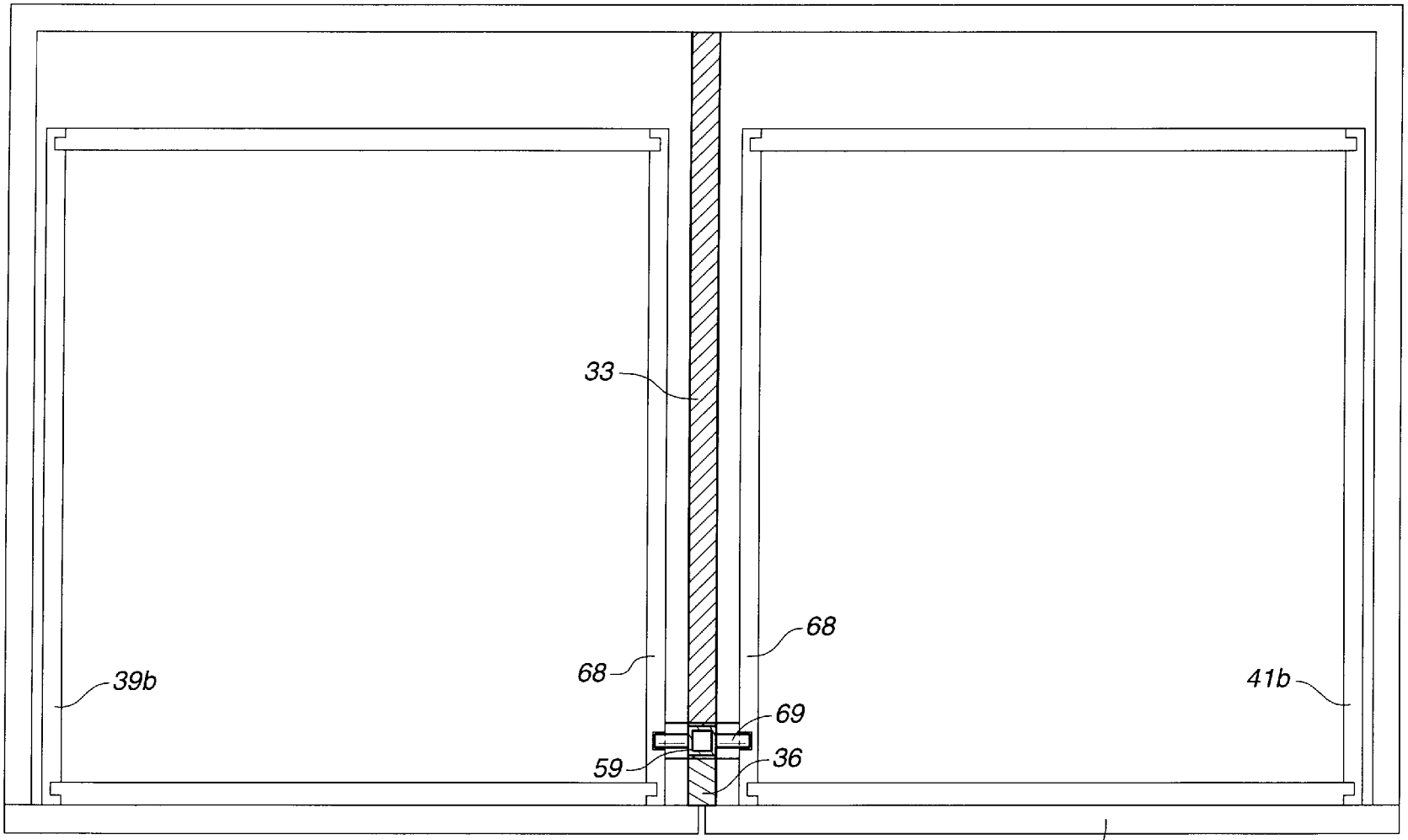
FIG. 4 is a cross-sectional view of the merchandise display case shown in FIG. 2A taken along section lines 4—4.
Figure 5:
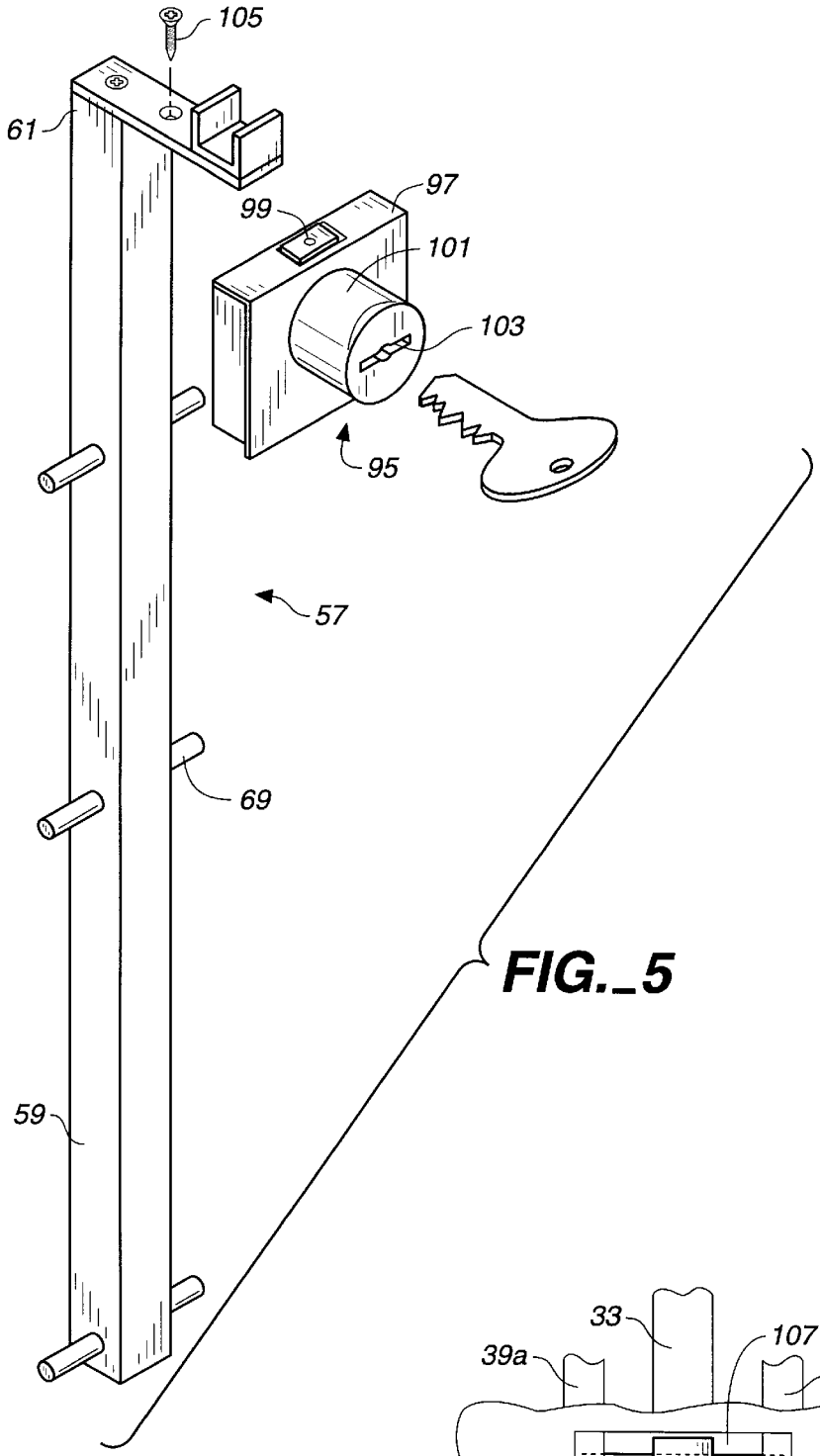
FIG. 5 is an exploded top perspective view of the gang lock unit of the invention shown in FIGS. 3A and 3B.

As above-described, the gang bar is vertically movable within the guide channel formed by partition wall 33 and edge strip 36. When raised, the gang bar will be in its locking position for simultaneously locking both banks of drawers and the sliding doors of the cabinet. When lowered, the gang bar will be in its unlocking position such that the drawers and doors of the cabinet can be opened. To move the gang bar between these two positions, gang lock unit 57 includes an accessible locking mechanism operatively connected to the gang bar. The locking mechanism is in the form of cylinder lock 95 having a base portion 97 which houses locking bolt 99. Cylinder lock 95 is mounted in the back face of cabinet 13 by mounting it in the cabinet's central facing strip 20 such that the cylinder portion 101 of the lock extends through the facing strip to provide an accessible key slot 103. So installed, the base portion of the cylinder lock is situated behind facing strip 20 such that the locking bolt 99 of the cylinder lock can be attached to offset support bracket 79. The locking bolt 99 is fastened to the offset support bracket by a suitable screw fastener 105 such that extension and retraction of the locking bolt will, as shown in FIGS. 3A and 3B, move the gang bar between its locking and unlocking positions. Thus, it can be seen that only one accessible locking mechanism is required to move the gang bar to secure both the drawers and the doors of the display case.

Figure 6:
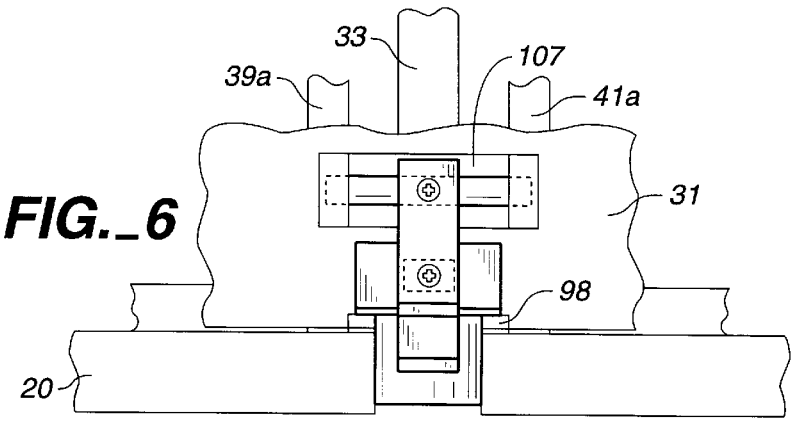
FIG. 6 fragmentary, cross-sectional view of the merchandise display case shown in FIG. 2A taken along section line 6—6.
Figure 7:
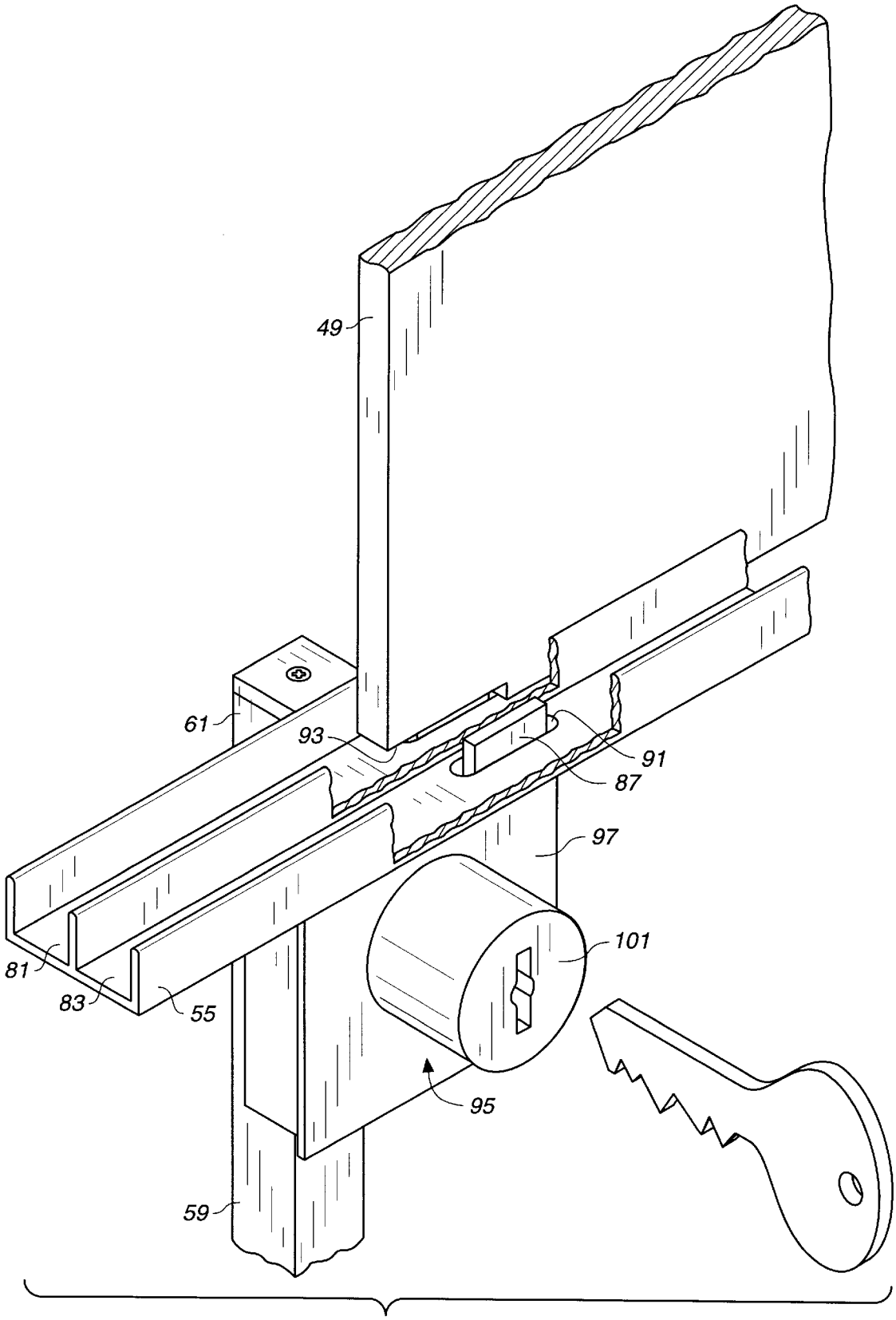
FIG. 7 is a top perspective, fragmentary view of the gang lock unit of the invention positioned to lockingly engage a cabinet door of the display case.

It can also be seen that the gang lock unit of the invention contains very few parts and is easy to install. The gang bar is installed by first securing the cylinder lock 95 to facing strip 20 by fitting the cylinder portion 101 of the lock into a predrilled hole on the facing strip and using screw fasteners (not shown) to secure the lock's mounting flange 96 to the front of the facing strip. As best shown in FIG. 6, a suitable spacer 98 can be provided between the facing strip and the mounting flange of the lock for achieving proper alignment of the gang bar with the drawer and the door notches. With the sliding doors 49, 51 and panel 29 removed, the assembly of the gang lock unit and facing strip can be inserted into place into the guide channel formed between vertical partition wall 33 and back edge strip 36, with a suitably sized rectangular opening 107 being provided in horizontal divider panel 31 to accommodate the gang bar 59 and the gang bar's laterally extending locking posts 69. Once in place, the facing strip 20 is secured to the cabinet to hold the gang lock unit 57 in its proper vertical alignment in the cabinet. It is noted that the cabinet's bottom wall 26 is provided with a recess 109 for accommodating the bottom end of the gang bar when the gang bar is lowered to its unlocking position as shown in FIG. 3A.

It can be appreciated that the display case and gang lock unit of the invention can be constructed in a variety of embodiments within the scope of the invention. For example, the display case can be provided with a single bank of drawers wherein locking posts are provided on one side the lower portion of the gang bar only. Moreover, the number and size of the drawers in each bank of drawers will depend on the particular requirements of the display case. Similarly, the doors of the cabinet can be hinged doors instead of sliding doors wherein the grabber member 77 at the top projecting end of the gang bar engages the bottom edge of the doors to prevent the doors from opening outwardly as opposed to sliding. It will still further be appreciated that the first and second compartments 25, 27 could be reversed such that the banks of drawers are above the doors. In such a case, the operation of the gang bar would be reversed for a particular application such that the bottom end is provided with an engaging member and such that the gang door locks the doors and drawers when it is lowered instead of raised.

Figure 8:
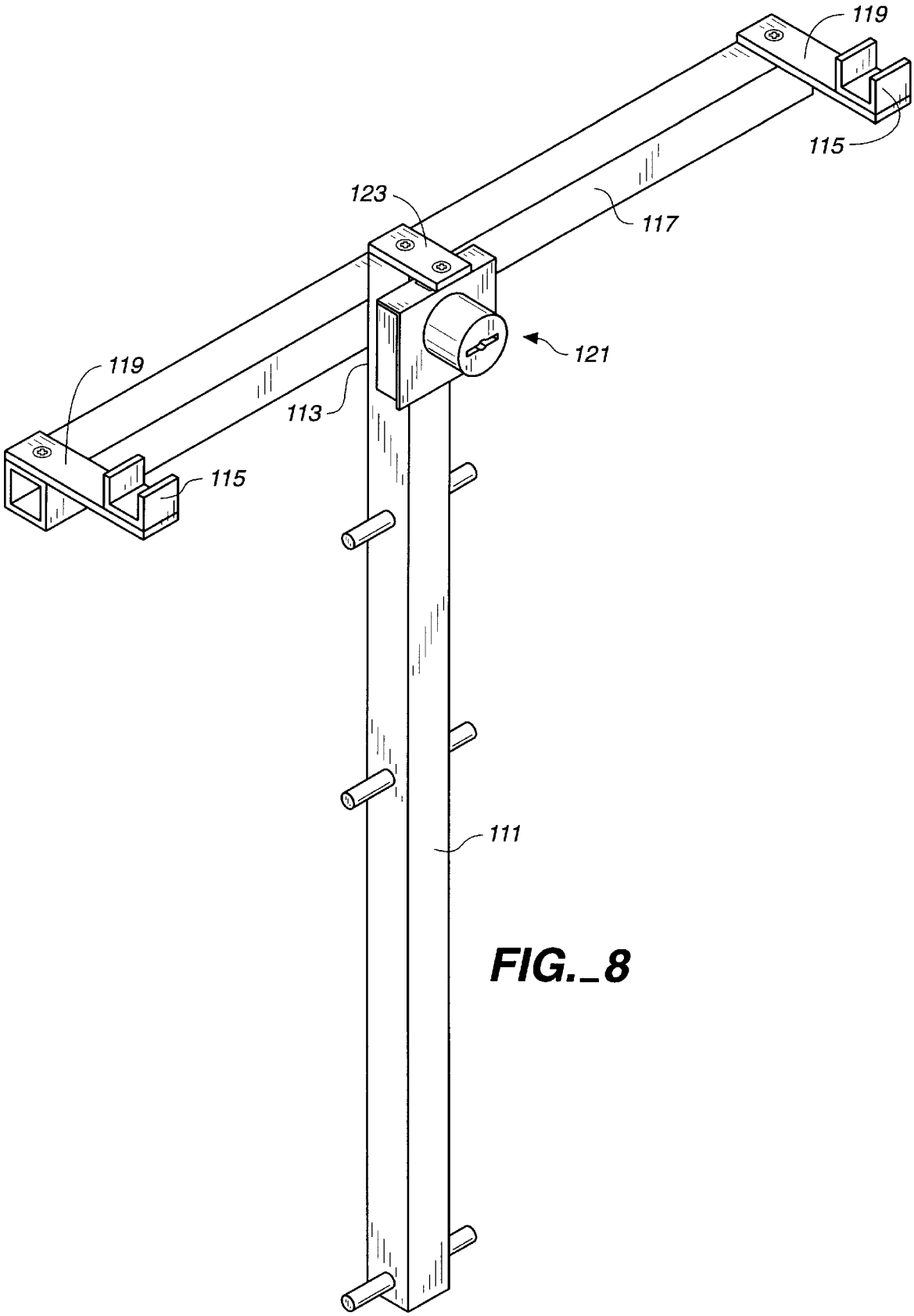
FIG. 8 is a top perspective view of an alternative embodiment of the gang lock unit of the invention for locking cabinet doors at two positions laterally displaced from the gang bar.

A further embodiment of the gang lock unit of the invention is shown in FIG. 8 wherein vertical gang bar 111 having top projecting end 113 includes two laterally disposed engaging elements 115 for aligning with and securing cabinet doors at two positions instead of one. The two engaging elements of this embodiment are held in a vertical plane that is offset relative to the gang bar by means of transverse support arm 117 and forwardly extending offset support brackets 119. The locking mechanism 121 is held in opposition to gang bar 111 by means of a third center lifting bracket 123 which is attached to the lock's retractable locking bolt (not shown) such that the gang bar can be raised and lowered in the same manner as described in connection with the embodiment illustrated in FIGS. 1–7.

Figure 9:
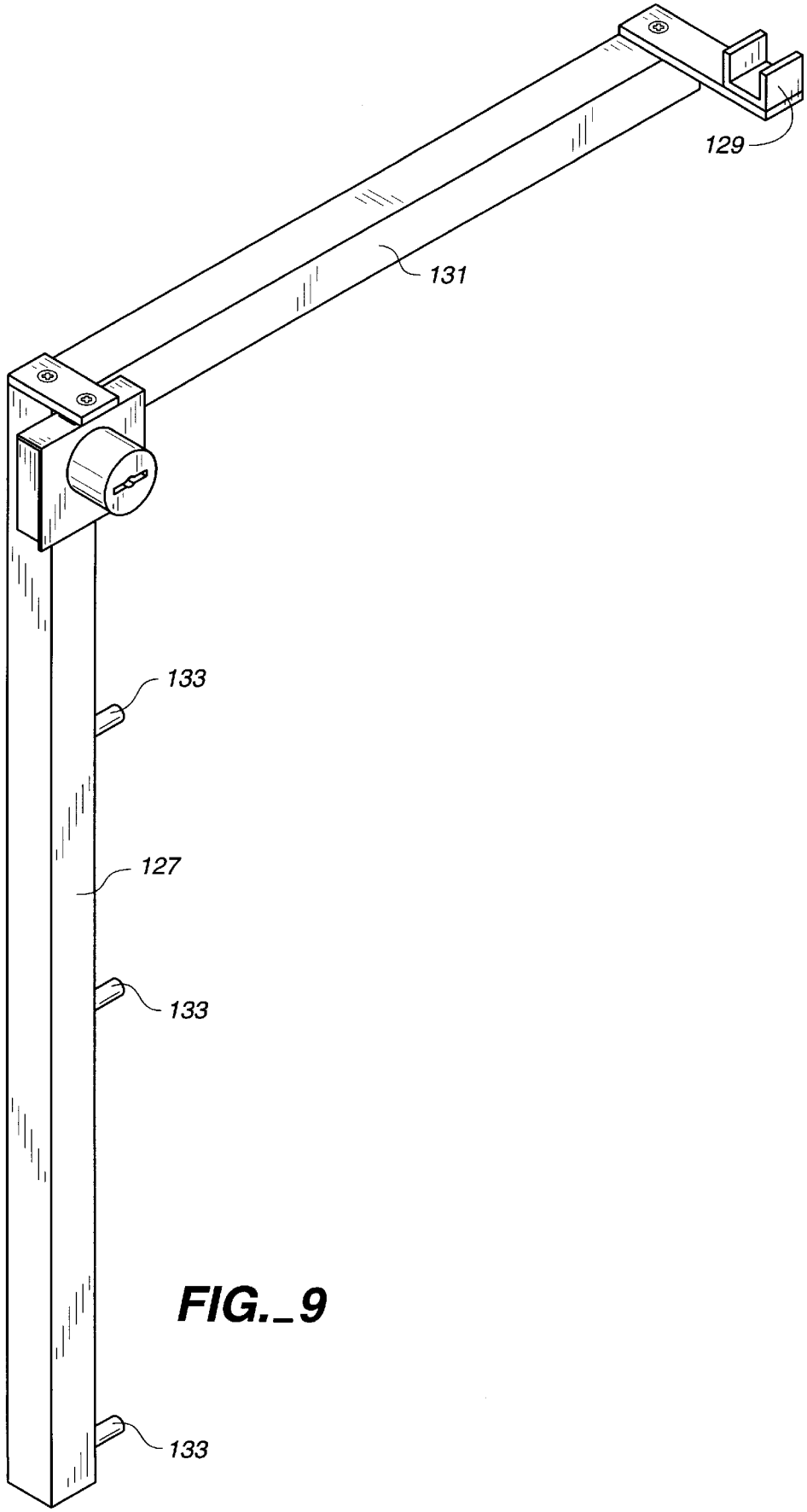
FIG. 9 is a top perspective view of an alternative embodiment of the gang lock unit of the invention for locking one bank of drawers and for locking cabinet doors at one position laterally displaced from the gang bar.

Similarly, a gang lock unit can be provided as shown in FIG. 9, wherein the engaging element for securing the cabinet doors is laterally offset with respect to the gang bar as well as being positioned forwardly of the gang bar to align with the cabinet doors. In the FIG. 9 embodiment, gang bar 127 supports a single engaging element 129 by means of transverse support arm 131 that extends laterally of the gang bar to position to engaging element at a predetermined position to the side of the gang bar. The gang bar assembly of FIG. 9 can be used in merchandise display cases where it is desired to position the gang bar to the side of a single bank of drawers, while engaging the cabinet doors in the center of the cabinet. Because the gang lock unit of FIG. 9 is used with a single bank of drawers, drawer locking posts 133 are provided on one side of the gang bar only.

It will be appreciated that a person skilled in the art can readily devise yet other configurations for the gang lock unit within the scope of the invention to meet particular requirements for the merchandise display case design.

While the invention has been described in considerable detail in the foregoing specification, it is not intended that the invention be limited to such detail except as necessitated by the following claims.

We claim:

1. A securable merchandise display case comprising a cabinet having a back face, a vertical region behind said back face, and vertically arranged first and second compartments behind said back face, at least one drawer disposed within said first compartment which is accessible from the back face of said cabinet and which is slidable between a closed position and an open position in a direction perpendicular to the back face of said cabinet, said drawer having a first catch means, a cabinet door movable between a closed position and an open position at the back face of the cabinet for accessing said second compartment, said cabinet door having a second catch means, a vertical gang bar extending through the first compartment of said cabinet within the vertical region behind the back face of said cabinet, said gang bar being movable within said vertical region vertically between a locking position and an unlocking position, first locking means carried on said gang bar for lockingly engaging the first catch means on said drawer when the drawer is in its closed position and when the gang bar is vertically moved to its locking position, second locking means carried on said gang bar for lockingly engaging the catch means on said cabinet door when said door is in its closed position and when the gang bar is vertically moved to its locking position, whereby the drawer and cabinet door of the display case are simultaneously locked and unlocked with the movement of said gang bar, and accessible locking mechanism operatively connected to said gang bar for moving said gang bar vertically between its locking position and its unlocking position.

2. The merchandise display case of claim 1 wherein said cabinet door opens and closes by sliding in a direction parallel to the back face of said cabinet and wherein said gang lock unit simultaneously prevents sliding movement of said drawer and door when said drawer and door are closed and said gang bar is moved to its locking position.

3. The merchandise display case of claim 1 wherein said cabinet door has a lateral edge portion proximate the first compartment of said cabinet and wherein the catch means for said door is provided on said lateral edge portion of said door.

4. The merchandise display case of claim 3 wherein said gang bar has a projecting end which extends to an elevation near the elevation of the edge portion of said cabinet door and is positioned in offset relation thereto, and wherein the second locking means on said gang bar extends from said projecting end in offset relation to said gang bar so as to lockingly engage the catch means on the edge portion of said cabinet door when said door is in its closed position and when said gang bar is moved to its locking position.

5. The merchandise display case of claim 1 wherein said gang bar is a rigid gang bar having a cross-sectional shape that prevents flexure of the gang bar in any direction.

6. The merchandise display case of claim 5 wherein said gang bar has a rectangular cross-sectional shape.

7. The merchandise display case of claim 6 wherein said gang bar is fabricated of rectangular metal tubing.

8. A securable merchandise display case comprising a cabinet having a back face, a vertical region behind said back face, and vertically arranged first and second compartments behind said back face, at least one drawer having a front panel, said drawer being disposed within said first compartment which is accessible from the back face of said cabinet and which is slidable between a closed position and an open position in a direction perpendicular to the back face of the cabinet, said drawer having first catch means located close behind the front panel thereof, a cabinet door movable between a closed position and an open position at the back face of the cabinet for accessing the second compartment of the display case, said cabinet door having a lateral edge portion proximate the first compartment of said cabinet and second catch means on the lateral edge portion of said door, a rigid vertical gang bar disposed in the vertical region behind the back face of said cabinet adjacent said drawer and being movable vertically between a locking position and an unlocking position, said gang bar having a projecting end which extends to an elevation near elevation of the lateral edge portion of said cabinet door, first locking means carried on said gang bar for lockingly engaging the catch means on said drawer when the drawer is in its closed position and when the gang bar is vertically moved to its locking position, second locking means carried on said gang bar substantially level with the projecting end thereof for lockingly engaging the catch means on the lateral edge portion of said cabinet door when said door is in its closed position and when the gang bar is moved to its locking position, whereby the drawer and cabinet door of the display case are simultaneously locked and unlocked with the movement of said gang bar, and accessible locking mechanism operatively connected to said gang bar for moving said gang bar between its locking position and its unlocking position.

9. The merchandise display case of claim 8 wherein the catch means on the lateral edge portion of said cabinet door is laterally offset relative to said gang bar, wherein the second locking means at the projecting end of said gang bar includes a vertically extending engaging element which engages and locks with the catch means on the lateral edge portion of said cabinet door when the gang bar is moved to its locking position, and wherein an offset support bracket extends laterally of the projecting end of the gang bar for holding said engaging element in alignment with the catch means of said cabinet door.

10. The merchandise display case of claim 9 wherein said accessible locking mechanism is mounted to the back face of said cabinet adjacent the offset support bracket holding said engaging element, said locking mechanism being operatively connected to said offset support bracket for vertically moving said gang bar between its locking and unlocking positions.

11. The merchandise display case of claim 8 wherein the first compartment of said cabinet further includes an internal gang bar support structure laterally adjacent said drawer, said gang bar support structure forming a vertical guide channel for containing the movement of said gang bar when the drawer and door of the cabinet are locked and unlocked.

12. The merchandise display case of claim 11 wherein said gang bar support structure includes an internal vertical partition wall having a vertical back edge positioned behind the back face of said cabinet and a back edge strip at the back face of said cabinet in opposition to back edge of said partition wall, and wherein said vertical guide channel is formed between the back edge of said partition wall and said back edge strip.

13. The merchandise display case of claim 11 wherein said gang bar has a rectangular cross-sectional shape.

14. A securable merchandise display case comprising a cabinet having a back face, a first compartment, a second compartment above said first compartment, and a gang bar support structure in said first compartment forming a vertical guide channel behind the back face of said cabinet, at least one bank of drawers disposed within said first compartment laterally adjacent said gang bar support structure, said drawer having a front panel and a first catch means behind said front panel, and being moveable between a closed position and an opened position in a direction perpendicular to the back face of the cabinet, a cabinet door in the back face of said cabinet and movable between a closed position and an open position for accessing said second compartment, said cabinet door having a lateral bottom edge portion proximate the first compartment of said cabinet and a second catch means in the bottom edge portion of said door whereby the second catch means of said cabinet door are offset relative to the first catch means of said drawers when said drawers are in their closed position, a rigid gang bar disposed in the vertical guide channel of the cabinet's gang bar support structure and being movable vertically within said guide channel between a raised locking position and a lowered unlocking position, said gang bar having an upper projecting end which extends to an elevation near the elevation of the bottom edge portion of said cabinet door and having a lower portion positioned laterally adjacent the first catch means of the drawers of said bank of drawers, first locking means laterally extending from the lower portion of said gang bar to lockingly engage the catch means on said drawers of said bank of drawers when the drawers are in their closed position and when the gang bar is raised to its locking position, second locking means held on the projecting end of said gang bar in offset relation thereto so as to align with the catch means on the bottom edge portion of said cabinet door when said door is in its closed position and so that the catch means of said cabinet door is lockingly engaged by the second locking means of said gang bar when the gang bar is raised to its locking position, whereby the drawer and cabinet door of the display case are simultaneously locked and unlocked by raising and lowering said gang bar, and accessible locking mechanism operatively connected to said gang bar for raising and lowering said gang bar between its locking position and its unlocking position.

15. The merchandise display case of claim 14 wherein two side by side banks of drawers are provided in said first compartment and wherein said gang bar guide channel is provided between said banks of drawers.

16. The merchandise display case of claim 14 wherein two adjacent cabinet doors are provided for preventing access to the second compartment of said cabinet, each of said cabinet doors having a lateral bottom edge portion proximate the first compartment of said cabinet and a second catch means in the bottom edge portion of said door, and wherein the second locking means on the upper projecting end of said gang bar aligns with the catch means of each cabinet door when the cabinet door is closed and simultaneously engages the catch means of each door when the gang bar is raised to its locking position.

17. A gang lock unit for a merchandise display case having a cabinet which includes a back face and vertically arranged first and second compartments behind said back face, said display case further having at least one drawer disposed within the first compartment of said cabinet, said drawer being slidable between a closed position and an open position in a direction perpendicular to the back face of said cabinet and having a first catch means, and said cabinet further including a cabinet door movable between a closed position and an open position at the back face of the cabinet for accessing the second compartment of said cabinet and wherein said door has a second catch means, said gang lock unit comprising a straight rigid gang bar having a top projecting end and a lower portion, laterally extending first locking means on the lower portion of said gang bar for lockingly engaging the first catch means on the cabinet drawer of said merchandise display case when the drawer is in its closed position and when the gang bar is vertically moved to a locking position, second locking means on the top projecting end of said gang bar for lockingly engaging the second catch means on the lateral edge portion of said cabinet door when said door is in its closed position and when the gang bar is moved to a locking position, whereby the drawer and cabinet door of the display case can be simultaneously locked and unlocked with the movement of said gang bar, and a locking mechanism operatively connected to said gang bar for moving said gang bar between a locking position and an unlocking position.

18. The gang lock unit of claim 17 wherein said gang bar has a cross-sectional shape that prevents flexure of the gang bar in any direction.

19. The gang lock unit of claim 18 wherein said gang bar is fabricated of rigid rectangular tubing.

20. The gang lock unit of claim 19 wherein said gang bar is fabricated of square metal tubing.

21. The gang lock unit of claim 19 wherein an offset support bracket extends perpendicularly from the top projecting end of said gang bar, and wherein said support bracket holds said second locking means in offset relation to said gang bar whereby the second locking means of said gang lock unit will align with offset second catch means one the door of the cabinet of said display case.

22. The gang lock unit of claim 21 wherein said locking mechanism is operatively connected to said support bracket for raising and lowering the gang bar within the cabinet of said display case.

23. The gang bar unit of claim 19 wherein a separate lifting bracket extends perpendicularly from the projecting end of said gang bar for attachably receiving a locking mechanism operative to raise and lower said gang bar.

24. A gang bar unit for a securable merchandise display case which includes a cabinet having a back face and vertically arranged first and second compartments behind said back face, at least one drawer disposed in said first compartment which is accessible from the back face of said cabinet and which is slidable between a closed position and an open position in a direction perpendicular to said back face, a cabinet door at the back face of the cabinet for accessing the second compartment of the display case, wherein said cabinet door has a lateral edge portion proximate the first compartment of the display case, and wherein a catch means is provided on the drawer and on the cabinet door, said gang bar unit comprising a straight gang bar having a projecting end, said gang bar being positionable adjacent the drawer of the merchandise display case within a confined vertical region behind the back face of the cabinet of the display case, first locking means carried on said gang bar for lockingly engaging the catch means on the drawer of a merchandise display case which is adjacent the gang bar when the gang bar is moved vertically behind the back face of the cabinet, a short offset bracket extending laterally of the projecting end of said gang bar, and second locking means carried on the offset support bracket for engaging the catch means on the cabinet door of the display case cabinet in offset relation to the gang bar with the same vertical movement of the gang bar which locks the cabinet drawer.

25. The gang bar unit of claim 24 wherein said gang bar has a rectangular cross-sectional shape.

26. The gang bar unit of claim 25 wherein said gang bar is fabricated of rectangular tubing.

27. The gang bar unit of claim 24 further comprising a locking mechanism operatively connected to the offset support bracket extending from said gang bar for raising and lower the gang bar between a locking and unlocking position, said locking mechanism being mountable to the back face of the display case cabinet so as to be accessible from the outside of the display case.

28. The gang bar unit of claim 24 further comprising a transverse support arm extending from the projecting end of the gang bar, said offset bracket extending perpendicularly from said transverse support arm at a predetermined position to the side of the vertical gang bar so as to carry the second locking means in sideward displaced relation to said gang bar for engaging a catch means on a cabinet door which is in sideward displaced relation to the vertical gang bar.

29. The gang bar unit of claim 28 wherein said transverse support arm extends from both sides of the gang bar for carrying a second locking means at a predetermined position to both sides of the gang bar for engaging a catch means on cabinet doors provided to both sides of the gang bar.

* * * * *